US007023351B2

(12) United States Patent
Park

(10) Patent No.: US 7,023,351 B2
(45) Date of Patent: Apr. 4, 2006

(54) APPARATUS AND METHOD OF CONTROLLING WATER SUPPLY OF WASHING MACHINE

(75) Inventor: Jae-Won Park, Suwon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 63 days.

(21) Appl. No.: 10/412,216

(22) Filed: Apr. 14, 2003

(65) Prior Publication Data

US 2004/0040345 A1 Mar. 4, 2004

(30) Foreign Application Priority Data

Aug. 28, 2002 (KR) ..... 2002-51265

(51) Int. Cl.
*G08B 21/00* (2006.01)

(52) U.S. Cl. ..... 340/608; 340/340; 340/603; 340/618; 340/679; 68/12.05; 68/17 R; 68/207

(58) Field of Classification Search ..... 340/608, 340/603, 605, 606, 607, 618, 679, 691.1, 340/616, 619, 620, 621, 622, 623, 624; 700/79, 700/21, 65; 68/3 R, 12.05, 16, 208, 17 R, 68/207; 134/167 C, 169 R, 169 C, 166 C, 134/22.12; 137/205, 154, 215, 803
See application file for complete search history.

(56) References Cited

U.S. PATENT DOCUMENTS

| | | | | |
|---|---|---|---|---|
| 4,955,213 | A * | 9/1990 | Ohsugi et al. | 68/12.12 |
| 5,125,247 | A * | 6/1992 | Mills | 340/624 |
| 5,714,939 | A | 2/1998 | Song | |
| 5,909,743 | A * | 6/1999 | Thies et al. | 134/10 |
| 6,598,431 | B1 * | 7/2003 | Teran et al. | 68/17 R |
| 6,778,868 | B1 * | 8/2004 | Imamura et al. | 700/79 |

* cited by examiner

*Primary Examiner*—Davetta W. Goins
(74) *Attorney, Agent, or Firm*—Staas & Halsey LLP

(57) ABSTRACT

An apparatus and a method of controlling a water supply of a washing machine, which naturally discharges the water within a detergent dissolving unit when the water level within the detergent dissolving unit is more than a designated water level so as to prevent the water within the detergent dissolving unit from overflowing, and warns of a clogging error in a water supply path when a number of times the water level within the detergent dissolving unit is more than a designated water level, is more than a designated number of times. Whether or not the water supply is provided is determined according to the number of times the water level within the detergent dissolving unit is more than the designated water level sensed by the water level sensor, thereby controlling a water supply action so as to stop the water supply only under abnormal conditions from supplying the water to a water tank, and improving a reliability of the apparatus.

31 Claims, 6 Drawing Sheets

P1
P2
P3
Ta
Tb

WATER SUPPLY VALVE

WATER LEVEL SENSOR

APPARATUS AND METHOD OF CONTROLLING WATER SUPPLY OF WASHING MACHINE

CROSS-REFERENCE TO RELATED APPLICATION

This application claims the benefit of Korean Application No. 2002-51265, filed Aug. 28, 2002, in the Korean Intellectual Property Office, the disclosure of which is incorporated herein by reference.

BACKGROUND OF THE INVENTION

1. Field of the Invention

The present invention relates to an apparatus and a method of controlling water supply of a washing machine so as to sense clogging of a water supply path of the washing machine.

2. Description of the Related Art

Generally, a washing machine is a device to wash laundry introduced into a washing tub using hydraulic force produced by rotating the washing tub containing the laundry along with washing water and a detergent.

As shown in FIG. 1, a conventional drum-type washing machine comprises a main body 1, a drum-type water tank 5 installed within the main body 1 containing washing water, and a washing tub 7 set within the drum-type water tank 5 and rotatable by a driving force of a motor 4 to wash or to rinse laundry contained therein. Further, the conventional drum-type washing machine comprises a water supply unit 3 installed above the drum-type water tank 5 so as to supply the washing water into the drum-type water tank 5 and dissolve a detergent in the washing water during a water supply operation, and a drain unit 8 installed below the drum-type water tank 5 so as to forcibly discharge the washing water from the drum-type water tank 5 after washing the laundry.

The water supply unit 3 includes a detergent dissolving unit 3*a*, a water supply valve 3*b*, a connection hose 3*c*, and a water supply pipe 3*d*. The detergent dissolving unit 3*a* serves to dissolve the detergent in the supplied washing water. The water supply pipe 3*d* connects an outlet of the water supply valve 3*b* to an inlet of the detergent dissolving unit 3*a*, and the connection hose 3*c* connects an outlet of the detergent dissolving unit 3*a* to an upper portion of the drum-type water tank 5.

In the water supply unit 3, when the water supply valve 3*b* is opened, the washing water from an external feed water pipe 2 is supplied to the detergent dissolving unit 3*a* via the water supply pipe 3*d* so as to dissolve the detergent contained within the detergent dissolving unit 3*a*. Then, the detergent-dissolved washing water is supplied to an inside of the drum-type water tank 5 via the connection hose 3*c*.

Since the supplied washing water passes through the detergent dissolving unit 3*a* of the water supply unit 3 of the conventional washing machine, the washing water and the dissolving detergent in the washing water are supplied to the drum-type water tank 5. At that time, the detergent contained within the detergent dissolving unit 3*a* is not completely dissolved in the washing water and the undissolved detergent is introduced into the connection hose 3*c*, thereby causing clogging in the connection hose 3*c*. As a result, the washing water is not smoothly supplied from the water supply unit 3 to the drum-type water tank 5, and then the washing water within the detergent dissolving unit 3*a* overflows.

SUMMARY OF THE INVENTION

Therefore, it is an aspect of the present invention to provide an apparatus and a method of controlling a water supply of a washing machine, which naturally discharges water within a detergent dissolving unit when a water level within the detergent dissolving unit is more than a designated water level so as to prevent the water within the detergent dissolving unit from overflowing, and warns of a clogging error in a water supply path when a number of times a water level within the detergent dissolving unit is more than a designated water level is more than a designated number of times.

Additional aspects and/or advantages of the invention will be set forth in part in the description which follows and, in part, will be obvious from the description, or may be learned by practice of the invention.

The above and/or other aspects can be accomplished by an apparatus for controlling a water supply in a washing machine provided with a detergent dissolving unit installed on a water supply path so as to supply a water-dissolved detergent to a water tank, comprising: a water level sensing unit sensing a level of water supplied to the detergent dissolving unit; and a controlling unit determining whether or not the water supply path is clogged according to the water level sensed by the water level sensing unit and then controlling a water supply action according to a determined result.

In accordance with another aspect, a method of controlling a water supply in a washing machine provided with a detergent dissolving unit installed on a water supply path so as to supply water-dissolved detergent to a water tank, comprising: sensing a level of water supplied to the detergent dissolving unit; determining whether or not the water supply path is clogged according to the sensed water level; and controlling a water supply action according to a determined result.

BRIEF DESCRIPTION OF THE DRAWINGS

These and other aspects and/or advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
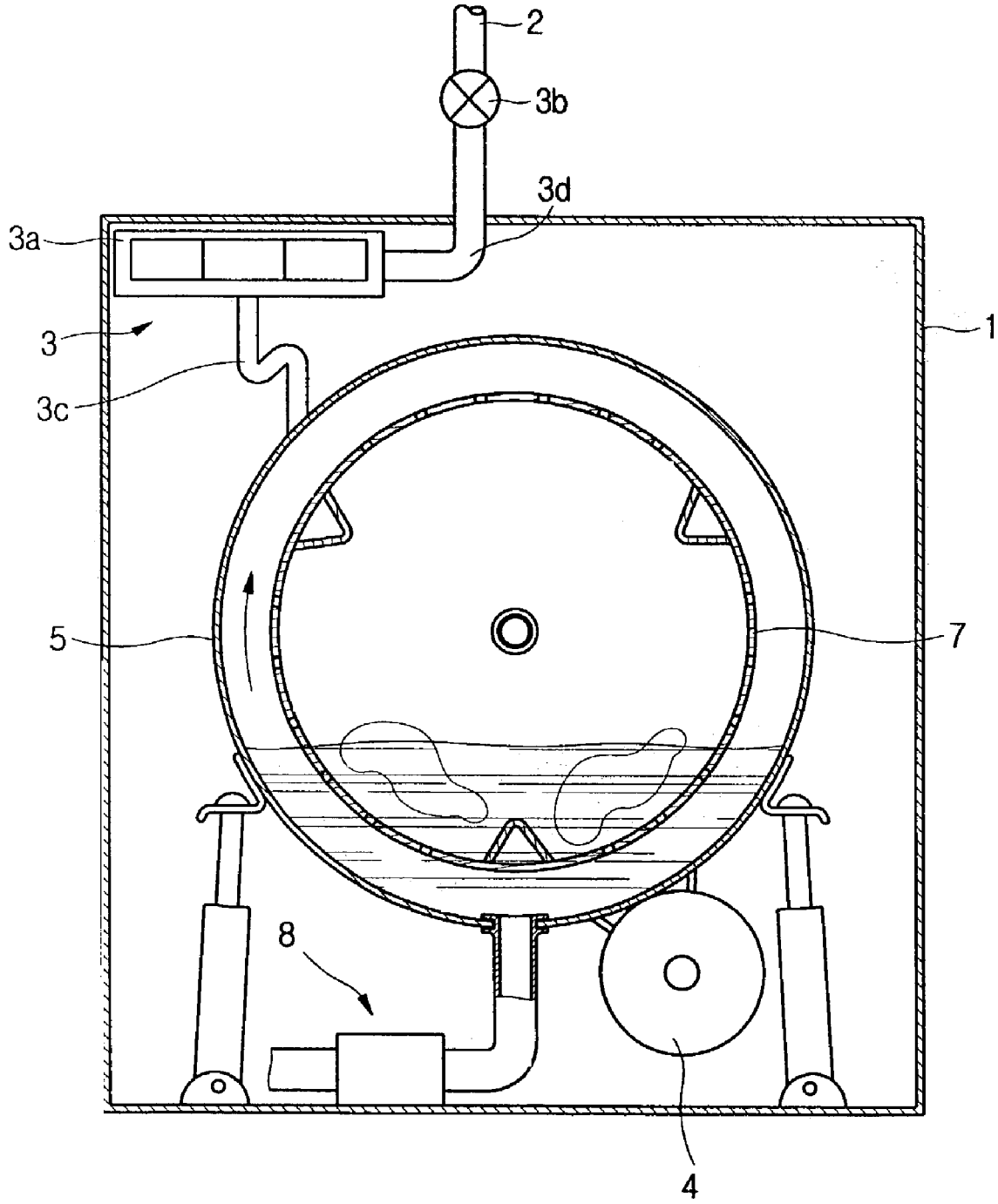
FIG. 1 (PRIOR ART)
FIG. 1 is a cross-sectional view of a conventional drum-type washing machine.

Reference will now be made in detail to the present preferred embodiments of the present invention, examples of which are illustrated in the accompanying drawings, wherein like reference numerals refer to the like elements throughout. The embodiments are described below in order to explain the present invention by referring to the figures.

Figure 2:
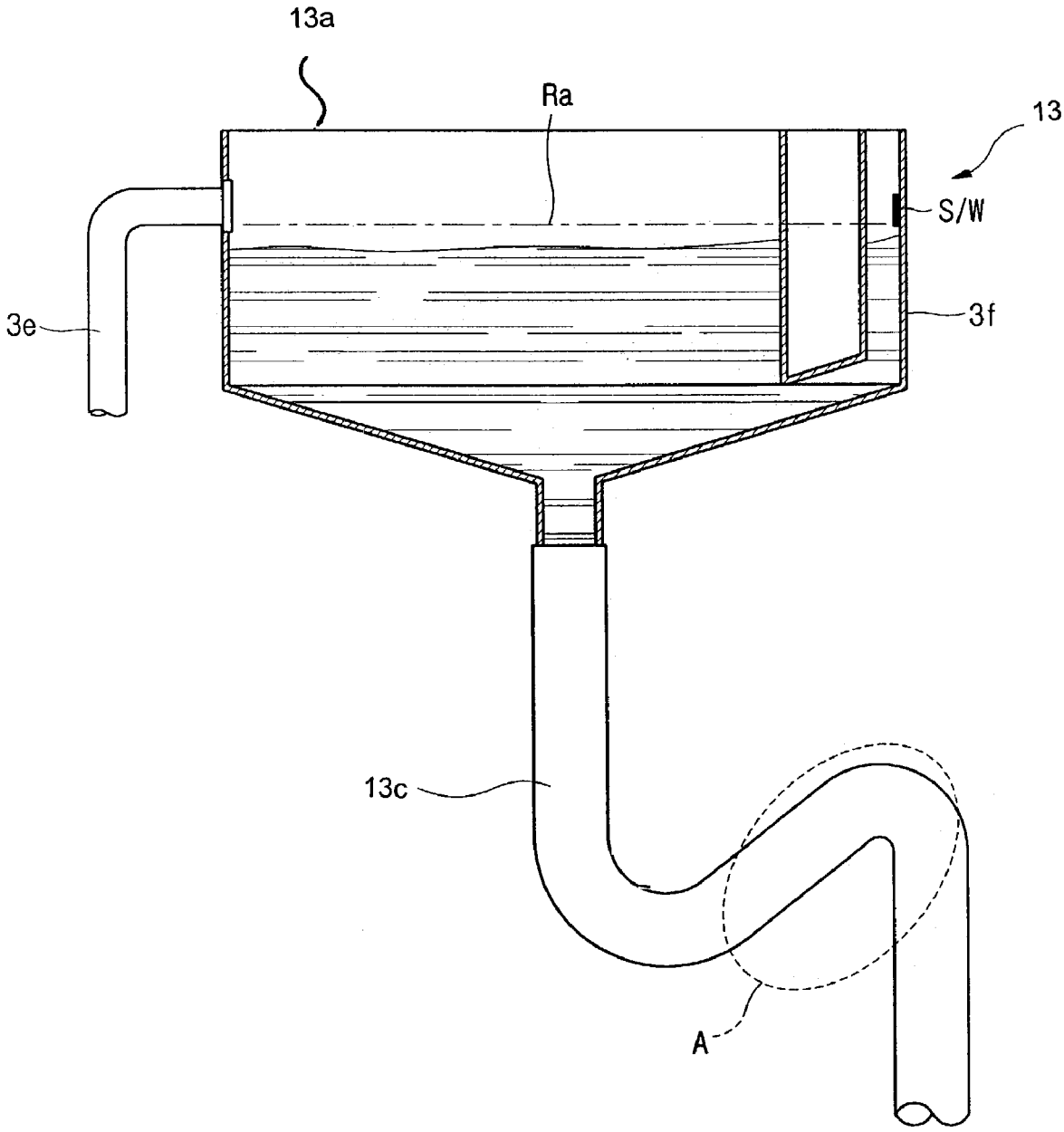
FIG. 2 is a cross-sectional view of a water supply unit of a washing machine in accordance with an embodiment of the present invention.

FIG. 2 is a cross-sectional view of a water supply unit of a washing machine in accordance with an embodiment of the present invention. Omitted elements having substantially the same functions as conventional elements will be denoted by the same reference numerals.

A water supply unit 13 of an embodiment of the present invention comprises the detergent dissolving unit 13*a*, the water supply valve 3*b*, and the water supply pipe 3*d*. The water supply unit 13 further comprises a drain pipe 3*e* and a water level sensor S/W. The drain pipe 3*e* serves to naturally discharge washing water within the detergent dissolving unit 13*a* when the level of supplied washing water exceeds a designated water level Ra, and the water level sensor S/W is installed on an upper portion of an inner wall of a branch pipe 3*f* so as to sense whether or not a level of the washing water supplied to the detergent dissolving unit 13*a* exceeds the designated water level Ra.

The drain pipe 3*e* connects an upper portion of the detergent dissolving unit 13*a* to a drainage outlet of a drain unit 8 to discharge the washing water used in washing laundry to an outside.

When the water supply valve 3*b* is opened so as to supply the washing water to the drum-type water tank 5, the washing water from an external feed water pipe 2 is supplied to the detergent dissolving unit 13*a* via the water supply pipe 3*d* and then dissolves a detergent contained within the detergent dissolving unit 13*a*, and the detergent-dissolved washing water is supplied to an inside of the drum-type water tank 5 via the connection hose 13*c*.

The connection hose 13*c* is narrowed by a hard clod of the detergent and other foreign substances deposited therein. Particularly, in a case where the connection hose 13*c* includes a bent portion preventing a backflow of foam, the connection hose 13*c* is more easily clogged, either partially or entirely, thereby raising the level of the washing water supplied to the detergent dissolving unit 13*a*. When the washing water level within the detergent dissolving unit 13*a* is raised and reaches the designated level Ra, the water level sensor S/W senses the washing water level and outputs a sensing signal. Then, a controlling unit 20 controls an opening of the water supply valve 3*b* and a closing of the water supply valve 3*b* according to the sensing signal of the water level sensor S/W.

Figure 3:
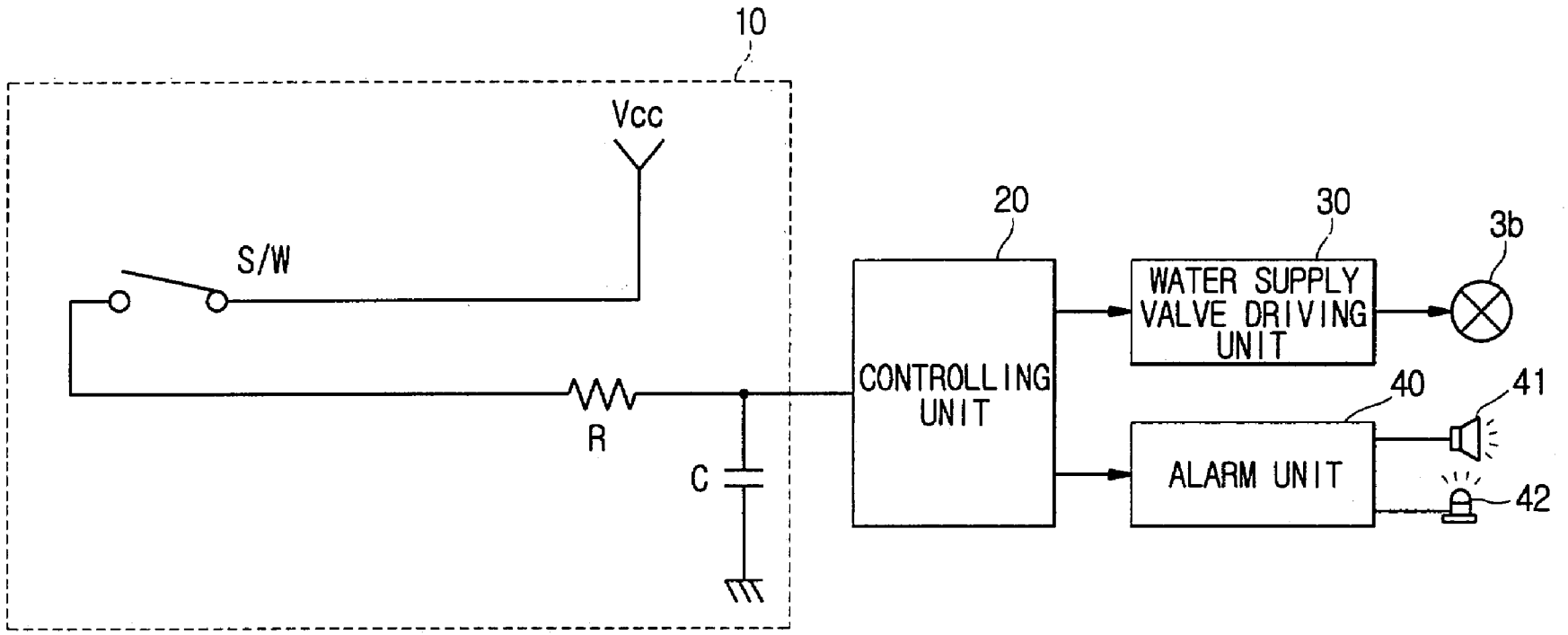
FIG. 3 is a block diagram of a water supply controlling device of the washing machine in accordance with the embodiment of the present invention.

FIG. 3 is a block diagram of a water supply controlling device of the washing machine in accordance with the embodiment of the present invention, and FIG. 4 is a view showing a timing between the water supply valve 3*b* and the water level sensor S/W of the washing machine in accordance with the present invention.

As shown in FIGS. 3 and 4, the water supply controlling device of the present invention comprises a water level sensing unit 10, a controlling unit 20, a water supply valve driving unit 30, and an alarm unit 40. The water level sensing unit 10 senses whether or not the level of the washing water supplied to the detergent dissolving unit 13*a* is more than the designated water level Ra. When the sensed water level is more than the designated water level Ra, the controlling unit 20 controls the washing water supply to stop and then to restart the washing water supply after a designated time. Further, when the number of times, in which the washing water level within the detergent dissolving unit 13*a* is more than a designated water level Ra, is more than a designated number of times, the controlling unit 20 warns of a clogging error of a water supply path. The water supply valve driving unit 30 opens and closes the water supply valve 3*b* according to a control action of the controlling unit 20. The alarm unit 40 audio-visually warns of a water supply error according to the control action of the controlling unit 20.

The water level sensing unit 10 comprises the water level sensor S/W, a resistor R, and a capacitor C. When the washing water level of the detergent dissolving unit 13*a* reaches the designated water level Ra, the water level sensor S/W is turned on, thereby inputting a high pulse signal to the controlling unit 20.

The water level sensing unit 10 may employ a float switch. When the washing water level within the detergent dissolving unit 13*a* reaches the designated water level Ra, the float switch connects a contact point thereof, thereby outputting a sensing signal of the high pulse.

Figures 4A, 4B:
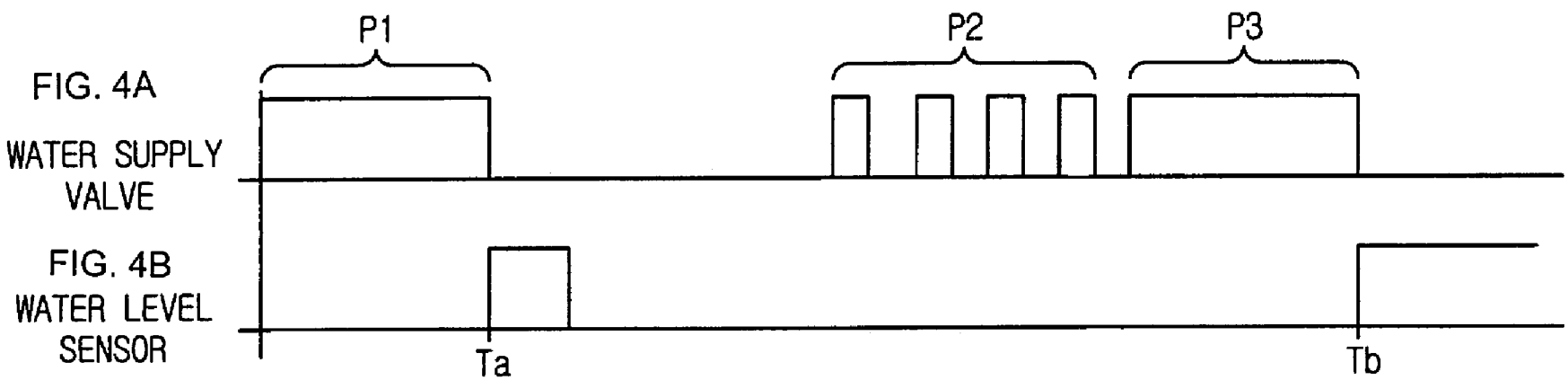
FIG. 4 is a view showing a timing between a water supply valve and a water level sensor of the washing machine in accordance with the embodiment of the present invention.

As shown in FIGS. 4A and 4B, when the connection hose 13*c* is clogged during supplying of the washing water to the detergent dissolving unit 13*a* by opening the water supply valve 3*b* for a designated period P1, the washing water level is raised and reaches the designated water level Ra at a designated time Ta.

The controlling unit 20 initially stops the washing water supply, and then alternatively opens and closes the water supply valve 3*b* for a designated period P2, thereby periodically providing the supply of the washing water. The periodic supply of the washing water by the controlling unit 20 causes the clod of the detergent and other foreign substances attached to an inside of the connection hose 13*c* to be easily eliminated, and allows the washing water to be intermittently supplied to the water supply unit 3.

Then, the controlling unit 20 opens the water supply valve 3*b* so as to re-supply the washing water to the water supply unit 13 at P3. During the washing water re-supply, when the sensed washing water level is more than the designated water level Ra, the controlling unit 20 recognizes that a normal washing water supply is impossible, and then entirely stops the washing water supply and warns of a water supply error.

Hereinafter, a method of controlling the washing water supply of the washing machine of the embodiment of the present invention will be described in detail.

Figure 5:
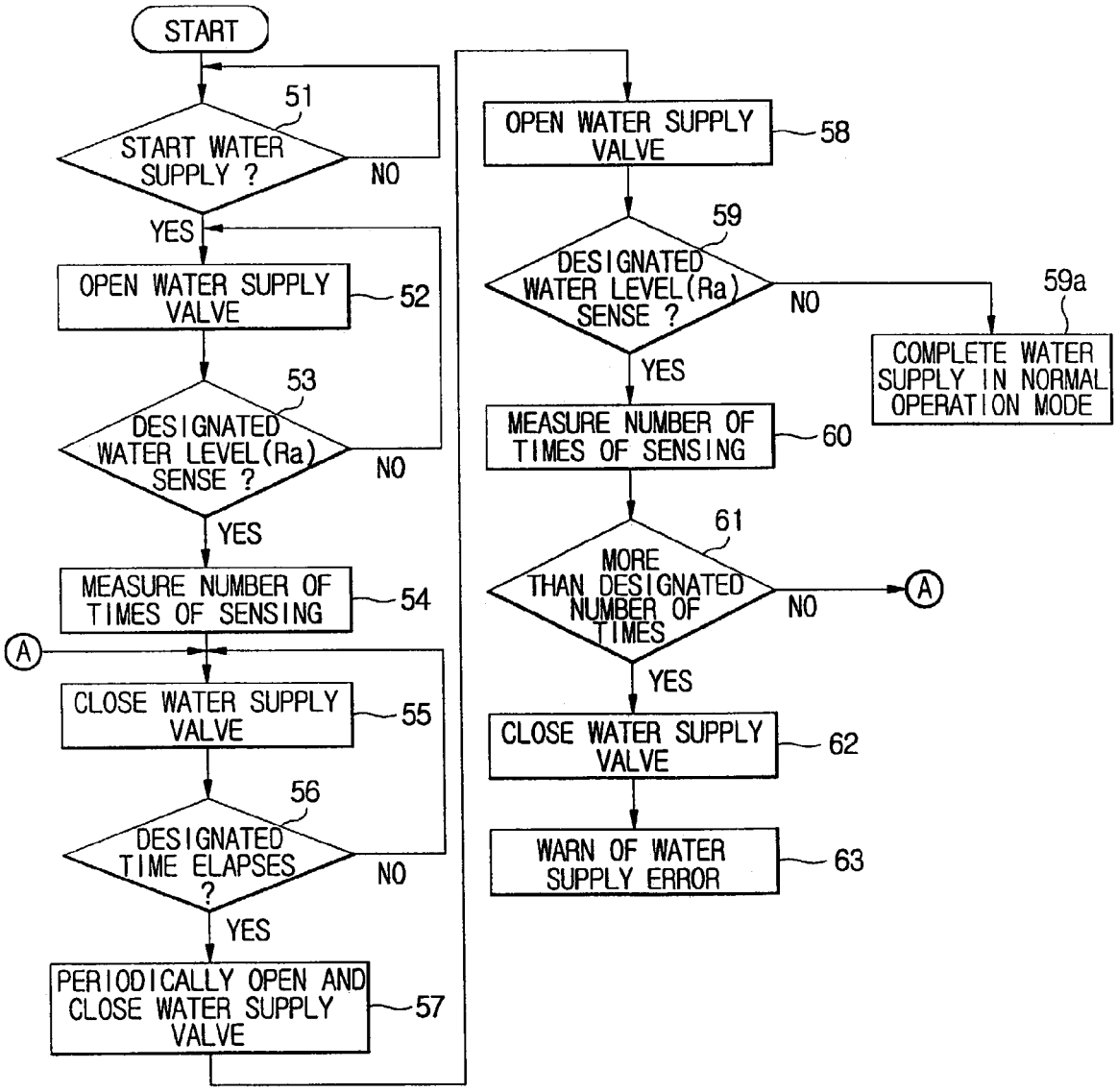
FIG. 5 is a flow chart showing a method of controlling a water supply of the washing machine in accordance with the embodiment of the present invention.

As shown in FIG. 5, the controlling unit 20 determines whether or not the washing water supply starts by a water supply order inputted by a manipulation of a washing start button in the washing machine at operation 51.

When the water supply order is inputted, the controlling unit 20 controls the water supply valve driving unit 30 to open the water supply valve 3*b* at operation 52. Then, the washing water from the external feed water pipe 2 is supplied to the detergent dissolving unit 13*a* and dissolves the detergent contained within the detergent dissolving unit 13*a*, and the detergent-dissolved washing water is supplied to the inside of the drum-type water tank 5 through the connection hose 13*c* (refer to P1).

At that time, when the connection hose 13*c* is clogged, the washing water is not smoothly supplied to the inside of the drum-type water tank 5, thereby raising the washing water level within the detergent dissolving unit 13*a*. When the washing water level is raised and reaches the designated water level Ra, the water level sensing unit 10 outputs the sensing signal of the high pulse to the controlling unit 20 and the washing water in an amount exceeding the designated water level Ra is naturally discharged to the drainage outlet of the drain unit 8 via the drain pipe 3*e*.

The controlling unit 20 determines whether or not the washing water level within the detergent dissolving unit 13*a* reaches the designated water level Ra according to the sensing signal outputted from the water level sensing unit 10 at operation 53. When the sensing signal of the high pulse is inputted to the controlling unit 20, the controlling unit 20 recognizes that the sensed washing water level has reached the designated water level Ra and then measures a number of the sensing times at operation 54.

Then, the controlling unit 20 closes the water supply valve 3*b* so as to stop the washing water supply (at operation 55.

After stopping the washing water supply, whether or not a designated time has elapsed is determined at operation 56. The determination allows the washing water contained within the detergent dissolving unit 13*a* to be supplied to the drum-type water tank 5 in a case where the water supply path in the connection hose 13*c* is somewhat clear (i.e., only partially obstructed).

As a result of the determination, unless the designated time has not elapsed, the washing water supply remains stopped, and when the designated time has elapsed, the water supply valve 3*b* is repeatedly opened and closed, thereby periodically providing the washing water supply at operation 57 (refer to P2). In this manner, by periodically providing the washing water supply, the clod of the detergent and other foreign substances deposited on the inside of the connection hose 13*c* can be eliminated and the complete stoppage of the washing water supply can be prevented, thereby continuously providing the washing water supply.

Then, since clogging of the connection hose 13*c* is prevented, the controlling unit 20 opens the water supply valve 3*b* so as to re-supply the washing water at operation 58 (refer to P3).

During the washing water re-supply, whether or not the sensed washing water level is more than the designated water level Ra is determined. As a result of the determination, unless the sensed washing water level is more than the designated water level Ra, the water supply valve 3*b* is kept continuously open in a normal operation mode, thereby completing the washing water supply at operation 59*a*.

Further, as the result of the determination, when the sensing signal of the high pulse is inputted, the controlling unit 20 recognizes that the sensed washing water level reaches the designated water level Ra and then measures the number of times the sensed washing water level reaches the designated water level Ra at operation 60.

Then, the controlling unit 20 determines whether the measured number of times of the sensing (i.e., the number of times the sensed washing water level having reached the designated water level Ra) is more than a designated number of times, at operation 61. As the result of the determination, unless the number of times of the sensing is more than the designated number of times, the washing water level is recognized to be temporarily raised due to a temporary clogging of the water supply path, and the process is returned to the operation 55. Alternatively, as the result of the determination, when the number of times of the sensing is more than the designated number of times, the controlling unit 20 recognizes that the normal washing water supply is impossible, and closes the water supply valve 3*b* so as to completely stop the washing water supply at operation 62. Then, the controlling unit 20 generates a buzzer via a speaker 41 and lights an alarm lamp 42, thereby an audio-visual warning of a water supply error is provided at operation 63.

Figure 6:
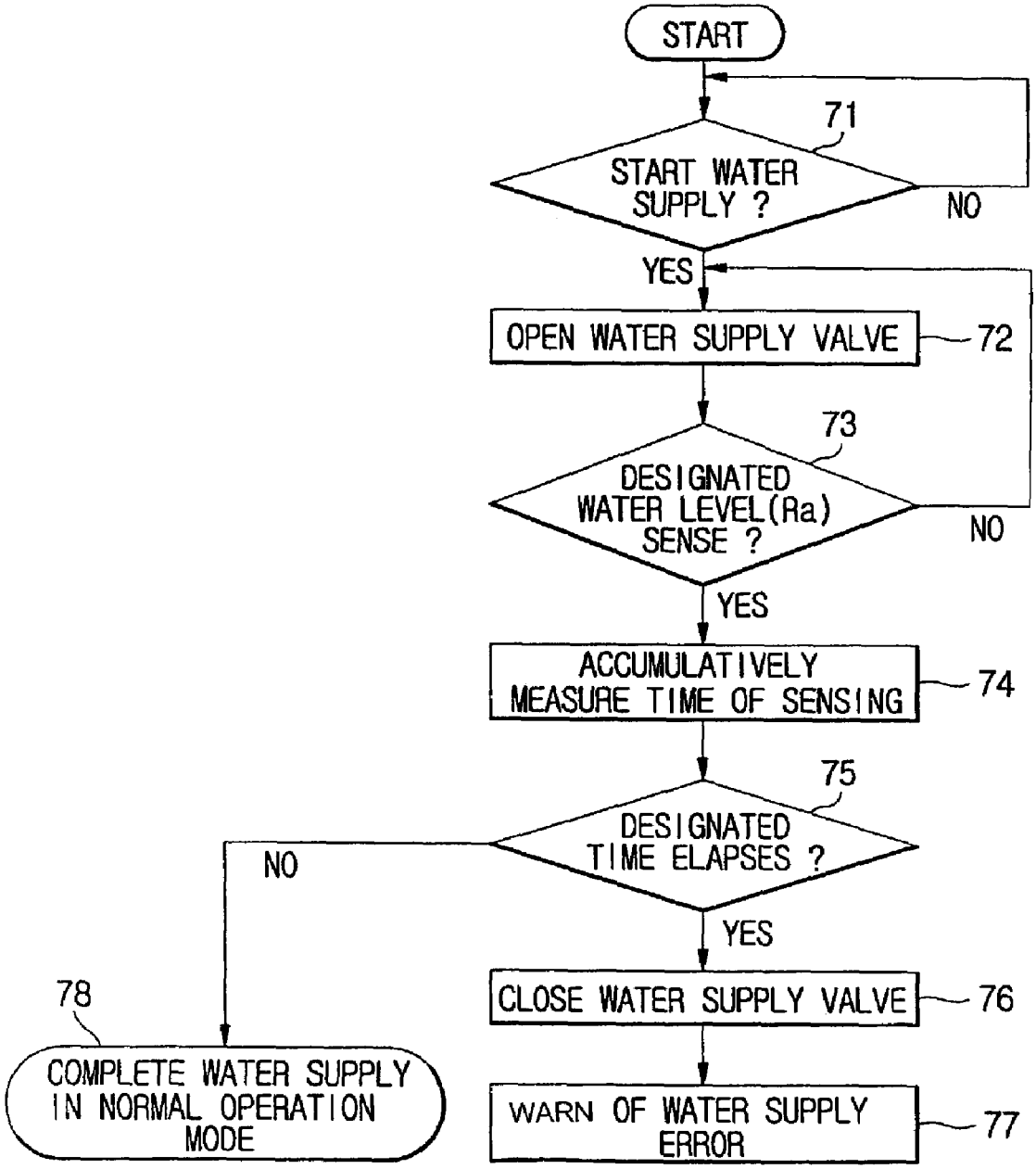
FIG. 6 is a flow chart showing a method of controlling a water supply of the washing machine in accordance with another embodiment of the present invention.

The above-described process in accordance with the embodiment of the present invention employs the method of controlling the water supply action of the washing machine according to the number of times when the sensed washing water level is more than the designated water level Ra. FIG. 6 illustrates another method of controlling the water supply action of the washing machine according to an accumulated time from when the sensed washing water level is maintained at more than the designated water level Ra.

The controlling unit 20 determines whether or not the water supply starts according to the water supply order inputted by a manipulation of a washing start button in the washing machine at operation 61.

When the water supply order is inputted, the controlling unit 20 controls the water supply valve driving unit 30 to open the water supply valve 3*b* at operation 62. Then, the washing water from the external feed water pipe 2 is supplied to the detergent dissolving unit 13*a* and dissolves the detergent contained within the detergent dissolving unit 13*a*, and the detergent-dissolved washing water is supplied to the inside of the drum-type water tank 5 through the connection hose 13*c*.

At that time, when the connection hose 13*c* is clogged, the washing water is not smoothly supplied to the inside of the drum-type water tank 5, thereby raising the washing water level within the detergent dissolving unit 13*a*. When the washing water level is raised and reaches the designated water level Ra, the water level sensing unit 10 outputs the sensing signal of the high pulse to the controlling unit 20 and the washing water in an amount exceeding the designated water level Ra is naturally discharged to the drainage outlet of the drain unit 8 via the drain pipe 3*e*.

The controlling unit 20 determines whether or not the washing water level within the detergent dissolving unit 13*a* reaches the designated water level Ra according to the sensing signal outputted from the water level sensing unit 10 at operation 63. As the result of the determination, when the sensing signal of the high pulse is inputted to the controlling unit 20, the controlling unit 20 accumulatively measures a time while the high pulse sensing signal is maintained at operation 64. Herein, the accumulatively measured time (the time while high pulse of the sensing signal is continuously maintained) refers to the time while the sensed water level within the detergent dissolving unit 13*a* is maintained at more than the designated water level Ra.

Then, the controlling unit 20 determines whether the accumulatively measured time exceeds a designated time at operation 75. As a result of the determination, in case the accumulatively measured time exceeds the designated time, the controlling unit 20 recognizes that a normal washing water supply is impossible and closes the water supply valve 3*b* so as to fully stop the washing water supply at operation 76. Then, the controlling unit 20 generates the buzzer via the speaker 41 and lights the alarm lamp 42, thereby the audio-visual warning of the water supply error is provided at operation 77.

As a result of the determination of the at operation 75, unless the accumulated sensing time is over than the designated time, the water supply valve 3*b* is continuously opened in a normal operation mode, thereby completing the water supply at operation 78.

As is apparent from the above description, the present invention provides an apparatus and a method of controlling a water supply of a washing machine, which naturally discharges the water within a detergent dissolving unit when the water level within the detergent dissolving unit is more than a designated water level so as to prevent the water within the detergent dissolving unit from overflowing, and determines whether or not the water supply is provided according to a number of times that a sensed water level is more than a designated water level by a water level sensor, thereby controlling a water supply action so as to stop the water supply only under abnormal conditions from supplying the water to a water tank, and improving a reliability of the apparatus.

Although a few preferred embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An apparatus for controlling a water supply in a washing machine provided with a detergent dissolving unit installed on a water supply path so as to supply a water-dissolved detergent to a water tank, the apparatus comprising:

a water level sensing unit sensing a level of water supplied to the detergent dissolving unit; and a controlling unit determining whether the water supply path is clogged according to the water level sensed by the water level sensing unit and controlling a water supply action so as to unclog the water supply path according to a result of the determination, wherein:

the controlling unit measures a number of times the water level sensed by the water level sensing unit is more than a designated water level, and the controlling unit stops the water supply to the detergent dissolving unit, when the measured number of times the water level is more than a designated water level is more than a designated number of times.

2. The apparatus for controlling a water supply in a washing machine as set forth in claim 1, wherein the designated water level is set to be more than 80% of a height of the detergent dissolving unit.

3. The apparatus for controlling a water supply in a washing machine as set forth in claim 1, wherein the controlling unit alternatively repeats starting and stopping of the water supply when a designated period has elapsed after the water supply stops.

4. The apparatus for controlling a water supply in a washing machine as set forth in claim 1, further comprising:

a drain pipe discharging the water in the detergent dissolving unit to an outside when the water level supplied to the detergent dissolving unit is more than a designated water level.

5. The apparatus for controlling a water supply in a washing machine as set forth in claim 1, further comprising:

an alarm unit audio-visually warning of a clogging error of the water supply path.

6. The apparatus for controlling a water supply in a washing machine as set forth in claim 1, wherein the controlling unit measures a period during which the water level sensed by the water level sensing unit is more than a designated water level.

7. The apparatus for controlling a water supply in a washing machine as set forth in claim 6, wherein the controlling unit stops the water supply to the detergent dissolving unit when the measured period is more than a designated period.

8. A method for controlling a water supply in a washing machine provided with a detergent dissolving unit installed on a water supply path so as to supply a water-dissolved detergent to a water tank, the method comprising:

sensing a level of water supplied to the detergent dissolving unit;

determining whether the water supply path is clogged according to the sensed water level, wherein the step of determining comprises:

measuring a number of times when the sensed water level is more than a designated water level, and comparing the measured number of times to a designated number of times; and controlling a water supply action so as to unclog the water supply path according to a result of the determination.

9. The method for controlling a water supply in a washing machine as set forth in claim 8, further comprising:

warning of a clogging error of the water supply path when the water supply path is clogged.

10. The method for controlling a water supply in a washing machine as set forth in claim 8, wherein controlling a water supply action comprises:

stopping the water supply for a designated time;

alternatively repeating starting and stopping of the water supply after a designated period has elapsed; and re-supplying the water.

11. The method for controlling a water supply in a washing machine as set forth in claim 10, wherein the controlling of the water supply action further comprises:

stopping the water supply and warning of a clogging error when the water supply path is clogged during the re-supplying.

12. The method for controlling a water supply in a washing machine as set forth in claim 8, wherein the determining of whether the water supply path is clogged comprises:

measuring an accumulated time when the water level sensed by the water level sensing unit is more than a designated water level; and comparing the accumulated time to a total designated time.

13. The method for controlling a water supply in a washing machine as set forth in claim 12, wherein the determining of whether the water supply path is clogged further comprises:

stopping the water supply and warning of a water supply error when the accumulated time is more than the designated time.

14. An apparatus for controlling a water supply unit in a washing machine provided with a detergent dissolving unit to supply a water-dissolved detergent to a water tank, comprising:

a water level sensing unit to sense a level of water supplied to the detergent dissolving unit; and a controlling unit to determine whether the water supply unit is clogged according to the sensed water level and to control a water supply action so as to unclog the water supply path according to a result of the determination, wherein:

the controlling unit measures whether a number of times the water level exceeds a threshold water level and if the measured number of times is more than a preset value, than the water supply unit is determined to be clogged, and the controlling unit stops the water supply to the detergent dissolving unit when the water supply unit is determined to be clogged.

15. The apparatus as set forth in claim 14, wherein the threshold water level is set corresponding to at least 80% of a capacity of the detergent dissolving unit.

16. The apparatus as set forth in claim 14, wherein the controlling unit alternatively and repeatedly starts and stops the water supply when a designated period has elapsed after the water supply is determined to be clogged.

17. The apparatus as set forth in claim 14, further comprising:

a drain pipe to discharge the water in the detergent dissolving unit when the water level in the detergent dissolving unit exceeds a threshold water level.

18. The apparatus as set forth in claim 14, further comprising:

an alarm unit to audibly and visually warn of a clog in the water supply unit.

19. The apparatus as set forth in claim 14, wherein the controlling unit measures a period during which the sensed water level is more than a threshold water level, and if the period, during which the sensed water level is more than a threshold water level, exceeds a threshold period, the water supply unit is determined to be clogged.

20. The apparatus as set forth in claim 19, wherein the controlling unit stops the water supply to the detergent dissolving unit when the water supply unit is determined to be clogged.

21. The apparatus as set forth in claim 14, wherein the washing machine is a drum-type washing machine.

22. The apparatus as set forth in claim 14, wherein the water supply unit includes a bent portion thereof to prevent a backflow of foam.

23. The apparatus as set forth in claim 14, wherein the water level sensing unit comprises:

a series connected switch, resistor and capacitor, in sequence, connected between two potentials, the switch turned on in response to a threshold water level such that a first signal level is inputted to the control unit when the switch is turned on and a second signal level is inputted to the control unit when the switch is turned off.

24. The apparatus as set forth in claim 14, wherein the switch is a float switch.

25. A method for controlling a water supply unit in a washing machine provided with a detergent dissolving unit to supply a water-dissolved detergent, comprising:

sensing a level of water supplied to the detergent dissolving unit;

determining whether the water supply unit is clogged according to the sensed water level, wherein the step of determining comprises:

measuring a number of times the water level exceeds a threshold water level, establishing the water supply unit to be clogged, if the measured number of times the water level exceeds a threshold water level is more than a preset value, and stopping a water supply to the detergent dissolving unit when the water supply unit is determined to be clogged; and controlling a water supply action so as to unclog the water supply path according to a result of the determination.

26. The method as set forth in claim 25, further comprising:

warning of a clog in the water supply unit.

27. The method as set forth in claim 25, wherein controlling a water supply action comprises:

stopping the water supply for a period;

alternatively and repeatedly starting and stopping a water supply after the period has elapsed; and re-supplying the water.

28. The method as set forth in claim 27, wherein controlling the water supply action further comprises:

stopping the water supply and warning of a clog when the water supply unit is clogged during the re-supplying.

29. The method as set forth in claim 25, wherein determining whether the water supply unit is clogged comprises:

measuring an accumulated time when the sensed water level exceeds a threshold water level; and comparing the measured accumulated time to a total threshold time.

30. The method as set forth in claim 29, wherein determining whether the water supply unit is clogged further comprises:

stopping a water supply and warning of a water supply error when the measured accumulated time exceeds the total threshold time.

31. An apparatus for controlling a water supply in a washing machine provided with a detergent dissolving unit installed on a water supply path so as to supply a water-dissolved detergent to a water tank, the apparatus comprising:

a controlling unit determining whether the water supply path is clogged according to a plurality of sensed water levels and controlling a water supply action so as to unclog the water supply path according to a result of the determination, wherein:

the controlling unit measures a number of sensed water levels, which are more than a designated water level, and the controlling unit stops the water supply to the detergent dissolving unit, when the number of sensed water levels is more than a designated number of sensed water levels.

* * * * *